US009330516B2

(12) United States Patent
DeRaedt et al.

(10) Patent No.: US 9,330,516 B2
(45) Date of Patent: May 3, 2016

(54) APPARATUS FOR RECEIVING AND SORTING DISKS

(71) Applicant: Shuffle Master GmbH & Co KG, Vienna (AT)

(72) Inventors: Peter Wolfgang DeRaedt, Reno, NV (US); Ludo DeMeutter, Borsbeck (BE)

(73) Assignee: SHUFFLE MASTER GMBH & CO KG, Vienna (AT)

( * ) Notice: Subject to any disclaimer, the term of this patent is extended or adjusted under 35 U.S.C. 154(b) by 28 days.

(21) Appl. No.: 14/222,307

(22) Filed: Mar. 21, 2014

(65) Prior Publication Data

US 2014/0202825 A1 Jul. 24, 2014

Related U.S. Application Data

(60) Continuation of application No. 13/662,665, filed on Oct. 29, 2012, now Pat. No. 8,678,164, which is a division of application No. 12/729,577, filed on Mar. 23, 2010, now Pat. No. 8,298,052, which is a (Continued)

(51) Int. Cl.
*G07D 11/00* (2006.01)
*G07D 3/14* (2006.01)
(Continued)

(52) U.S. Cl.
CPC ..... *G07D 3/14* (2013.01); *G07D 9/008* (2013.01); *G07D 9/06* (2013.01); *G07F 1/06* (2013.01); *G07F 17/3297* (2013.01)

(58) Field of Classification Search
CPC ..... G07D 7/00; G07D 3/14; G07D 2205/00; G07D 9/06; G07D 9/065
USPC ..... 194/302; 453/13, 34, 49, 57, 61; 53/212
See application file for complete search history.

(56) References Cited

U.S. PATENT DOCUMENTS 1,200,843 A 10/1916 Baur
1,241,632 A 10/1917 Johnson
(Continued)

FOREIGN PATENT DOCUMENTS

AT 006405 10/2003
AT 006 546 12/2003
(Continued)

OTHER PUBLICATIONS

Cover sheet of 1993 video tape describing the Chipmaster (author unknown).
(Continued)

*Primary Examiner* — Mark Beauchaine
(74) *Attorney, Agent, or Firm* — TraskBritt

(57) ABSTRACT

An apparatus for receiving and sorting disks includes a wheel having at least one well for receiving a disk, a motor coupled to the wheel, a collecting device positioned relative to the wheel, a disk sensor, an ejector, and a controller. The collecting device has at least a first collector and a second collector configured for receiving disks. The disk sensor is configured to detect a value of a parameter of a disk received in the well and generate a parameter value signal. The ejector is coupled to the wheel proximate the well and configured to eject a disk from the well in a plane parallel to a bottom surface of the wheel in response to an eject signal. The controller is operably coupled with the disk sensor and the ejector.

20 Claims, 7 Drawing Sheets

Related U.S. Application Data continuation of application No. 11/682,132, filed on Mar. 5, 2007, now Pat. No. 7,681,708, which is a continuation of application No. 11/069,426, filed on Mar. 1, 2005, now Pat. No. 7,201,268, which is a division of application No. 10/742,722, filed on Dec. 19, 2003, now Pat. No. 6,976,589.

(60) Provisional application No. 60/444,178, filed on Feb. 3, 2003.

(51) Int. Cl.

| | |
|---|---|
| ***G07D 9/00*** | (2006.01) |
| ***G07D 9/06*** | (2006.01) |
| ***G07F 1/06*** | (2006.01) |
| ***G07F 17/32*** | (2006.01) |

(56) References Cited

U.S. PATENT DOCUMENTS

| | | | | |
|---|---|---|---|---|
| 1,813,296 | A * | 7/1931 | Kidwell | 453/12 |
| 1,947,456 | A | 2/1934 | Bock | |
| 2,020,293 | A | 11/1935 | Adelstein | |
| 2,073,789 | A | 3/1937 | Gee | |
| 2,231,093 | A | 2/1941 | Seemel | |
| 2,904,151 | A | 9/1959 | Johnson | |
| 3,143,118 | A | 8/1964 | Haines | |
| 3,371,761 | A | 3/1968 | Ryo | |
| 3,387,616 | A | 6/1968 | Bortz et al. | |
| 3,435,833 | A | 4/1969 | Tanaka | |
| 3,497,047 | A | 2/1970 | Mobley | |
| 3,583,410 | A | 6/1971 | Bayha et al. | |
| 3,680,566 | A | 8/1972 | Tanaka et al. | |
| 3,766,452 | A | 10/1973 | Burpee et al. | |
| 3,771,538 | A | 11/1973 | Reis | |
| 3,827,582 | A * | 8/1974 | Lederer | 414/798.5 |
| 3,902,511 | A | 9/1975 | Jacobs | |
| 4,010,766 | A * | 3/1977 | Bowles et al. | 453/40 |
| 4,157,139 | A | 6/1979 | Bjork | |
| 4,161,381 | A | 7/1979 | Sciortino | |
| 4,164,232 | A | 8/1979 | Nakai et al. | |
| 4,209,960 | A | 7/1980 | Deutschlander et al. | |
| 4,275,751 | A | 6/1981 | Bergman | |
| 4,360,034 | A | 11/1982 | Davila et al. | |
| 4,427,389 | A | 1/1984 | D'Andrade | |
| 4,531,531 | A | 7/1985 | Johnson et al. | |
| 4,543,969 | A | 10/1985 | Rasmussen | |
| 4,607,649 | A | 8/1986 | Taipale et al. | |
| 4,681,128 | A | 7/1987 | Ristvedt et al. | |
| 4,731,043 | A | 3/1988 | Ristvedt et al. | |
| 4,775,354 | A | 10/1988 | Rasmussen et al. | |
| 4,863,414 | A | 9/1989 | Ristvedt | |
| 4,902,263 | A * | 2/1990 | Ito et al. | 453/49 |
| 4,966,570 | A | 10/1990 | Ristvedt et al. | |
| 5,011,455 | A | 4/1991 | Rasmussen | |
| 5,011,456 | A | 4/1991 | Kobayashi et al. | |
| 5,022,889 | A | 6/1991 | Ristvedt et al. | |
| 5,042,810 | A | 8/1991 | Williams et al. | |
| 5,074,434 | A | 12/1991 | Maki | |
| 5,141,443 | A | 8/1992 | Rasmussen et al. | |
| 5,166,502 | A | 11/1992 | Rendleman et al. | |
| 5,207,612 | A | 5/1993 | Wollaston | |
| 5,277,651 | A | 1/1994 | Rasmussen et al. | |
| 5,406,264 | A | 4/1995 | Plonsky et al. | |
| 5,460,295 | A | 10/1995 | Law | |
| 5,472,074 | A | 12/1995 | Milcetic | |
| 5,531,331 | A | 7/1996 | Barnett | |
| 5,551,542 | A | 9/1996 | Stockli | |
| 5,607,352 | A | 3/1997 | Tani et al. | |
| 5,624,308 | A | 4/1997 | Rumbach | |
| 5,651,548 | A | 7/1997 | French et al. | |
| 5,735,742 | A | 4/1998 | French et al. | |
| 5,755,618 | A | 5/1998 | Mothwurf | |
| 5,757,876 | A | 5/1998 | Dam et al. | |
| 5,770,533 | A | 6/1998 | Franchi | |
| 5,781,647 | A | 7/1998 | Fishbine et al. | |
| 5,827,117 | A | 10/1998 | Naas | |
| 5,836,583 | A | 11/1998 | Towers | |
| 5,865,673 | A | 2/1999 | Geib et al. | |
| 5,895,321 | A | 4/1999 | Gassies et al. | |
| 5,931,732 | A | 8/1999 | Abe et al. | |
| 5,933,244 | A | 8/1999 | Kiritchenko | |
| 5,947,257 | A | 9/1999 | Schwartz | |
| 5,950,796 | A | 9/1999 | Kobayashi | |
| 5,957,262 | A | 9/1999 | Molbak et al. | |
| 5,957,776 | A | 9/1999 | Hoehne et al. | |
| 6,021,949 | A | 2/2000 | Boiron et al. | |
| 6,075,217 | A * | 6/2000 | Kiritchenko | 209/582 |
| 6,080,056 | A | 6/2000 | Karlsson | |
| 6,139,418 | A | 10/2000 | Geib et al. | |
| 6,168,001 | B1 | 1/2001 | Davis | |
| 6,186,895 | B1 | 2/2001 | Oliver | |
| 6,193,599 | B1 | 2/2001 | Kurosawa et al. | |
| 6,260,757 | B1 | 7/2001 | Strisower | |
| 6,264,109 | B1 | 7/2001 | Chapet et al. | |
| 6,283,856 | B1 | 9/2001 | Mothwurf | |
| 6,296,190 | B1 | 10/2001 | Rendleman | |
| 6,313,871 | B1 | 11/2001 | Schubert | |
| 6,381,294 | B1 | 4/2002 | Britton | |
| 6,464,584 | B2 | 10/2002 | Oliver | |
| 6,506,115 | B1 | 1/2003 | Mothwurf | |
| 6,532,297 | B1 | 3/2003 | Lindquist | |
| 6,540,602 | B2 | 4/2003 | Adams et al. | |
| 6,567,159 | B1 | 5/2003 | Corech | |
| 6,572,474 | B2 | 6/2003 | Rudd | |
| 6,581,747 | B1 | 6/2003 | Charlier et al. | |
| 6,592,445 | B2 | 7/2003 | Lee | |
| 6,629,591 | B1 | 10/2003 | Griswold et al. | |
| 6,733,388 | B2 | 5/2004 | Mothwurf | |
| 6,753,830 | B2 | 6/2004 | Gelbman | |
| 6,772,870 | B2 | 8/2004 | Sugai et al. | |
| 6,976,589 | B2 | 12/2005 | De Raedt et al. | |
| 7,004,831 | B2 | 2/2006 | Hino et al. | |
| 7,014,554 | B1 | 3/2006 | Fletcher et al. | |
| 7,028,826 | B2 | 4/2006 | De Raedt et al. | |
| 7,066,335 | B2 | 6/2006 | Aas et al. | |
| 7,201,268 | B2 | 4/2007 | DeMeutter et al. | |
| 7,244,175 | B2 | 7/2007 | Adams et al. | |
| 7,681,708 | B2 | 3/2010 | De Raedt et al. | |
| 7,704,133 | B2 | 4/2010 | Adams et al. | |
| 7,861,868 | B2 | 1/2011 | Blaha et al. | |
| 7,934,980 | B2 | 5/2011 | Blaha et al. | |
| 8,006,847 | B2 | 8/2011 | Blaha et al. | |
| 8,202,144 | B2 | 6/2012 | Hino et al. | |
| 8,298,052 | B2 | 10/2012 | Deraedt et al. | |
| 8,336,699 | B2 | 12/2012 | Blaha et al. | |
| 2002/0061724 | A1 * | 5/2002 | Nomura | 453/6 |
| 2002/0074209 | A1 * | 6/2002 | Karlsson | 194/330 |
| 2004/0149539 | A1 | 8/2004 | De Raedt et al. | |
| 2005/0155838 | A1 | 7/2005 | Raedt et al. | |
| 2005/0280212 | A1 | 12/2005 | Blaha et al. | |
| 2007/0099553 | A1 | 5/2007 | Blaha et al. | |
| 2007/0212996 | A1 | 9/2007 | Ryou | |

FOREIGN PATENT DOCUMENTS

| | | |
|---|---|---|
| AT | 007 854 | 10/2005 |
| CA | 2090073 | 8/1994 |
| CA | 2229054 | 8/1996 |
| CA | 2229053 | 10/1996 |
| DE | 3144327 A1 | 5/1983 |
| DE | 4240886 | 7/1994 |
| EP | 0424355 | 11/1994 |
| EP | 0631260 | 12/1994 |
| EP | 0757582 | 2/1997 |
| EP | 0806020 | 12/1998 |
| EP | 1080348 | 8/2002 |
| EP | 0823041 | 9/2002 |
| EP | 0950989 | 9/2003 |
| EP | 1050024 | 3/2004 |
| FR | 2 749 093 | 7/1998 |
| FR | 2 752 078 | 10/1998 |
| GB | 720 707 | 12/1954 |
| GB | 1 255 492 | 12/1971 |

(56) References Cited

FOREIGN PATENT DOCUMENTS

| | | | |
|---|---|---|---|
| GB | 1 571 219 | | 7/1980 |
| GB | 2 061 490 | | 5/1981 |
| GB | 2 198 274 | | 6/1988 |
| GB | 2 203 582 | | 10/1988 |
| GB | 2 254 419 | | 10/1992 |
| GB | 2 333 632 | | 7/1999 |
| IT | 94 A001040 | | 12/1994 |
| WO | 91/17842 | | 11/1991 |
| WO | 92/11953 | | 7/1992 |
| WO | 95/28996 | | 11/1995 |
| WO | 96/23281 | | 8/1996 |
| WO | 96/34258 | | 10/1996 |
| WO | 99/38126 | | 7/1999 |
| WO | 99/60353 | | 11/1999 |
| WO | 03/049045 | | 6/2003 |
| WO | 03/103860 | | 12/2003 |
| WO | 2004/009256 | A1 | 1/2004 |
| WO | 2004/069431 | A2 | 8/2004 |
| WO | 2008/046561 | A1 | 4/2008 |
| WO | 2011/051700 | A1 | 5/2011 |

OTHER PUBLICATIONS

Chipmaster Training handouts from Jan. 1994 (author unknown).
Huxley's advertisement for Chipmaster: Huxley's count on the Chipmaster deal, ("Casino World" is distributed in the U.S.) Mar. 1994 (author unknown).
Show report for Chipmaster in Monte Carlo by Christian Pohanka, Mar. 23, 1993.
Trial installation of Chipmaster at Holland Casinos, report by Christian Pohanka, Sep. 29, 1993.
Report from Spain regarding Chipmaster by Christina Pohanka, Sep. 26, 1993.
Photograph of first Chipmaster installation at Casino Baden (Austria), Jan. 4, 2004 (photographer unknown).
Photograph of first Chipmaster installation at Holland Casinos, Jan. 4, 2004 (photographer unknown).
Photograph of first Chipmaster installation at Valencia (Spain), Jan. 4, 2004 (photographer unknown).
Photograph of Chipmaster production at VICOMA, Vienna, Jan. 4, 2005 (photographer unknown).
Photographs of Chipmaster in Paulson Booth at Apr. 26-27, 1994 Show (photographer unknown).
International Search Report dated Mar. 6, 2008, for International Application No. PCT/EP2007/008873 (2 pages).
PCT International Search Report for International Application No. PCT/US04/02331 dated Jun. 23, 2006 (2 pages).
Written Opinion for Application No. PCT/US04/02331, dated Jun. 23, 2006 (3 pages).
International Preliminary Report for Application No. PCT/US04/02331, dated Dec. 14, 2006 (3 pages).
International Preliminary Report for Application No. PCT/EP2007/008873, dated Apr. 22, 2009, 6 pages.
Written Opinion for Application No. PCT/EP2007/008873, dated Mar. 6, 2008, 5 pages.
PCT International Search Report and Written Opinion of the International Searching Authority for PCT/GB2010/051763, dated Mar. 30, 2011, 14 pages.

* cited by examiner

APPARATUS FOR RECEIVING AND SORTING DISKS

CROSS-REFERENCE TO RELATED APPLICATIONS

The present application is a continuation application of U.S. patent application Ser. No. 13/662,665 filed Oct. 29, 2012, now U.S. Pat. No. 8,678,164, issued Mar. 25, 2014, which, in turn, is a divisional of U.S. patent application Ser. No. 12/729,577, filed Mar. 23, 2010, now U.S. Pat. No. 8,298,052, issued Oct. 30, 2012, which is a continuation of U.S. patent application Ser. No. 11/682,132, filed Mar. 5, 2007, now U.S. Pat. No. 7,681,708, issued Mar. 23, 2010, which is a continuation of U.S. patent application Ser. No. 11/069,426, filed Mar. 1, 2005, now U.S. Pat. No. 7,201,268, issued Apr. 10, 2007, which is a divisional of U.S. application Ser. No. 10/742,722, filed Dec. 19, 2003, now U.S. Pat. No. 6,976,589, issued Dec. 20, 2005, which claims priority to U.S. Provisional Patent Application Ser. No. 60/444,178, filed Feb. 3, 2003, the entire disclosure of each of which is hereby incorporated herein by this reference.

TECHNICAL FIELD

The present invention relates generally to sorting articles, and more particularly, to an apparatus for sorting disk-shaped articles.

BACKGROUND

Sorting devices of this general type exist in many different embodiments and may be used for sorting disks of widely different kinds. A common field of application is coin sorting. In this field of application, the disks are constituted by coins and their identities are represented by their denomination and may be separated by dimension, weight, electrical properties, radio-frequency identification (RFID) or any other characteristic of the coins by which they differ from the others. There are also fields of application other than coin sorting such as sorting tokens, labeling disks, electrical and optical filter disks, coil cores, and so on.

Still another field of application is the sorting of gaming chips and the like, and the invention will be illustrated by the description of the embodiment which is particularly adapted for the sorting of gaming chips. However, the applicability of the invention is not limited to the sorting of gaming chips, but also embraces sorting of other disks or disk-like articles.

Another apparatus for sorting and/or handling of disk-like members was invented in 1979, see U.S. Pat. No. 4,157,139 assigned to Bertil Knutsson. This device is called the "Chipper Champ." The device described in U.S. Pat. No. 4,157,139, however, uses a conveyor belt to separate and distribute the articles. The apparatus is rather complex as it uses a lot of mechanical parts to separate, transport and stack the disk-like articles. In addition, after having identified the unique characteristics of the any one of the articles, the apparatus is only capable of stacking one article at any one given time. Furthermore, the device is very large and, when using the apparatus for sorting gaming chips, the device interferes with the operator as it not only reduces the available working space of the apron on a roulette table, it also impedes the movement of the dealer on the floor.

After separation, the gaming chips are stacked into a rack in which ten columns are placed in a horizontal plane at 45 degrees, one next to the other. With this device, the dealer is only able to stand to one side of the device, and not directly behind it, as the distance to the roulette table is too far to reach. This necessitates, on occasion, the dealer having to extend his arm and body laterally to retrieve chips from the farthest columns. This creates an uncomfortable and unnatural working condition.

Due to the internal mechanical design of the Chipper Champ, the device can jam, and break or damage the gaming chips.

Besides the abovementioned apparatus, other devices have been produced specifically for use within the gaming industry. One of these is called the "ChipMaster" from CARD (Casino Austria Research and Development), the "Chameleon" and the "Chipper 2000" (U.S. Pat. No. 6,075,217). The ChipMaster is only used by CARD and is a mechanically very complex device. Its operation is unique in that it pushes the gaming chips through the table but this requires substantial modification to the gaming table for it to be fitted. In addition, the device is substantial in size and is specifically designed for a roulette table. The Chameleon has been withdrawn from the market due to operational flaws and the Chipper 2000 is an exact copy of the Chipper Champ mentioned above.

The present invention is aimed at one or more of the problems identified above.

SUMMARY

In one aspect of the present invention, an apparatus for receiving and sorting disks having a parameter is provided. The parameter of each disk has one of a plurality of values. The apparatus includes a frame, a wheel, a motor, a disk sensor, a collecting device, and an ejector. The wheel has at least one hole forming a well for receiving a disk. The motor is coupled to the frame and the wheel for controllably rotating the wheel about an axis. The disk sensor is coupled to the frame and positioned relative to the well. The sensor senses the value of the parameter of the disk and responsively generates a parameter value signal as a function of the value. The collecting device is coupled to the frame and positioned relative to the wheel. The collecting device has at least first and second collectors for receiving disks. The ejector is coupled to the frame and positioned relative to the well. The ejector ejects the disk from the well in response to receiving an eject signal. The apparatus further includes a controller coupled to the disk sensor and the ejector. The controller receives the parameter value signal and responsively sends an eject signal to the ejector to eject the disk from the well into the first collector when the parameter value signal has a first value and sends an eject signal to the ejector to eject the disk from the well into the second collector when the parameter value signal has a second value.

In another aspect of the present invention, an apparatus for receiving and sorting disks having a parameter is provided. The parameter of each disk has one of a plurality of values. The apparatus includes a frame, a wheel, a motor, a disk sensor, a collecting device, and a plurality of ejectors. The wheel has a plurality of holes forming a plurality of wells. Each well receives a disk and is rotatably coupled to the frame. The motor is coupled to the frame and the wheel and controllably rotates the wheel about an axis. The disk sensor is coupled to the frame and positioned relative to the well. The sensor senses the value of the parameter of the disk and responsively generates a parameter value signal. The collecting device is coupled to the frame and positioned relative to the wheel. The collecting device has a plurality of collectors for receiving disks. Each collector is associated with one of the values of the parameter. The plurality of ejectors are coupled to the frame and positioned relative to the plurality of wells. Each ejector ejects a disk from the well in response to receiving an eject signal. A controller is coupled to the disk sensor and the plurality of ejectors. The controller receives the parameter value signal and responsively sends an eject signal to at least one of the ejectors to eject the disk from at least one of the wells into a respective collector as a function of the parameter value signal.

In still another aspect of the present invention, a collecting device assembly for use with an apparatus for sorting disks has a first end and a second end and a plurality of collectors. Each collector has first and second ends. The first ends of the collectors are aligned with the first end of the collecting device assembly. The second ends of the collectors are aligned with the second end of the collecting device assembly. The first ends of the collectors are arranged in a semi-circle and have a first radius.

In yet another embodiment of the present invention, a method for receiving and sorting disks having a parameter is provided. The parameter of each disk has one of a plurality of values. The apparatus includes a rotating wheel. The wheel has at least one well for receiving a disk. The wheel receives a first disk in a first well. The method includes the steps of sensing the value of the parameter of the first disk and ejecting the first disk into one of a plurality of collectors when the first well is aligned with the one collector and the value of the parameter of the first disk is equal to a value associated with the one collector.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
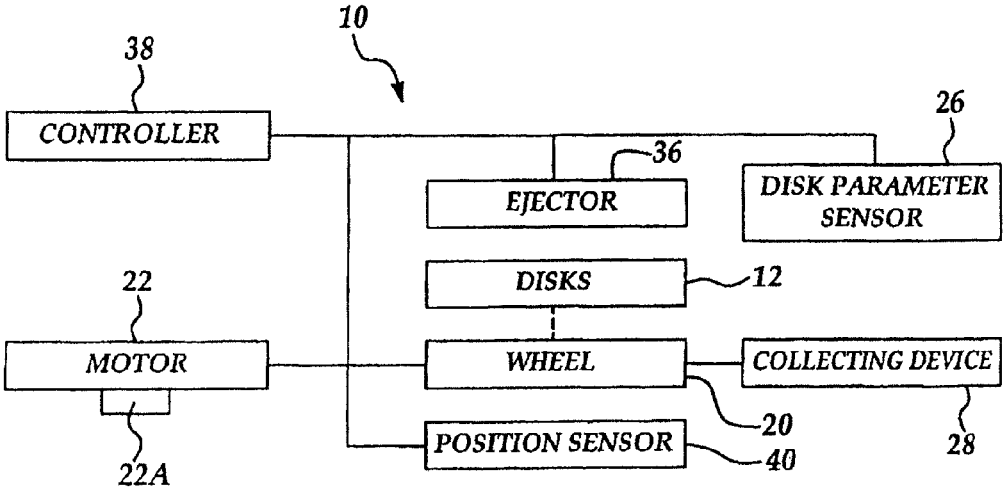
FIG. 1 is a block diagram of an apparatus for receiving and sorting disks.

With reference to FIG. 1 and in operation, the present invention provides an apparatus or sorting device 10 for receiving and sorting disks 12. The disks 12 have a parameter. The disks 12 may be differentiated by the value of the parameter. For example, the disks 12 may be gaming chips, which typically have different colors representing different monetary values. It should be noted, however, that the present invention is not limited to the parameter being color. Any type of parameter that may be sensed or detected to distinguish and separate disks may be used. For example, the parameter may be, but is not limited to, one of color, an image, bar code (or other discernible pattern), or RFID created by an embedded integrated circuit (IC) chip.

Figure 2:
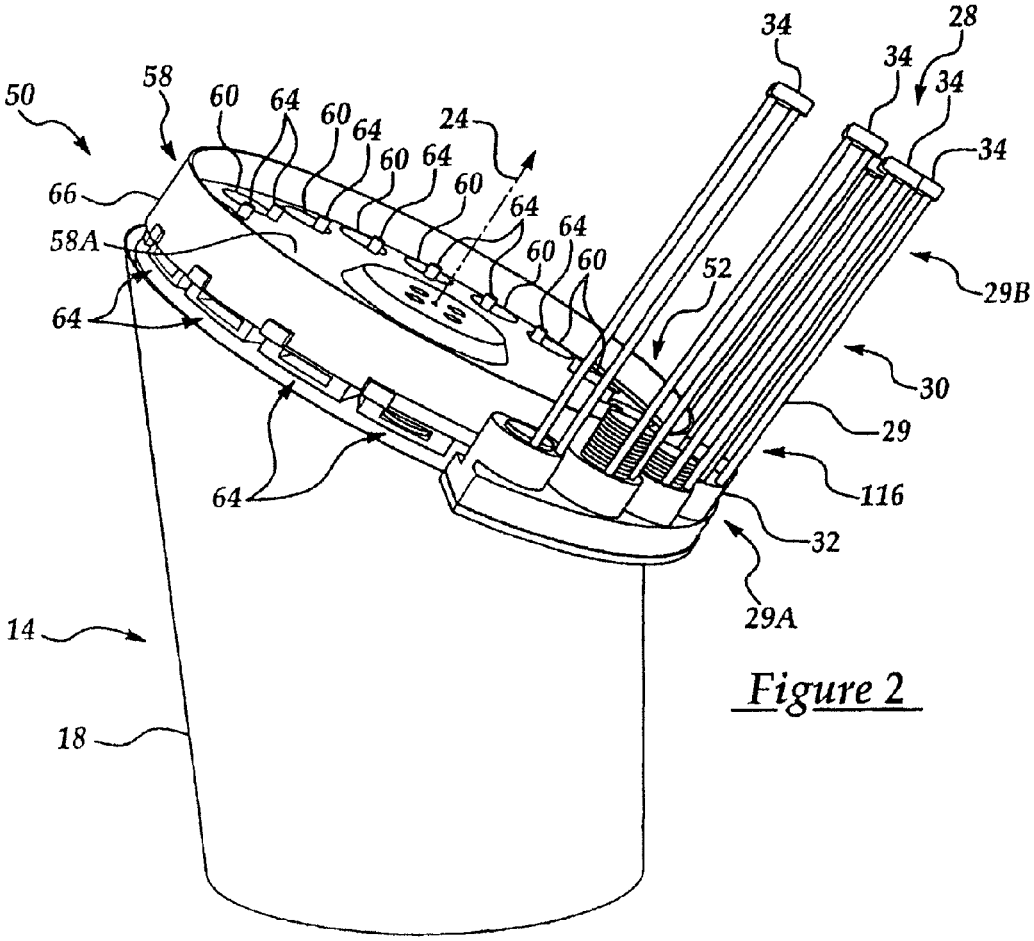
FIG. 2 is a first diagrammatic illustration of the apparatus of FIG. 1, according to an embodiment of the present invention.
Figure 3:
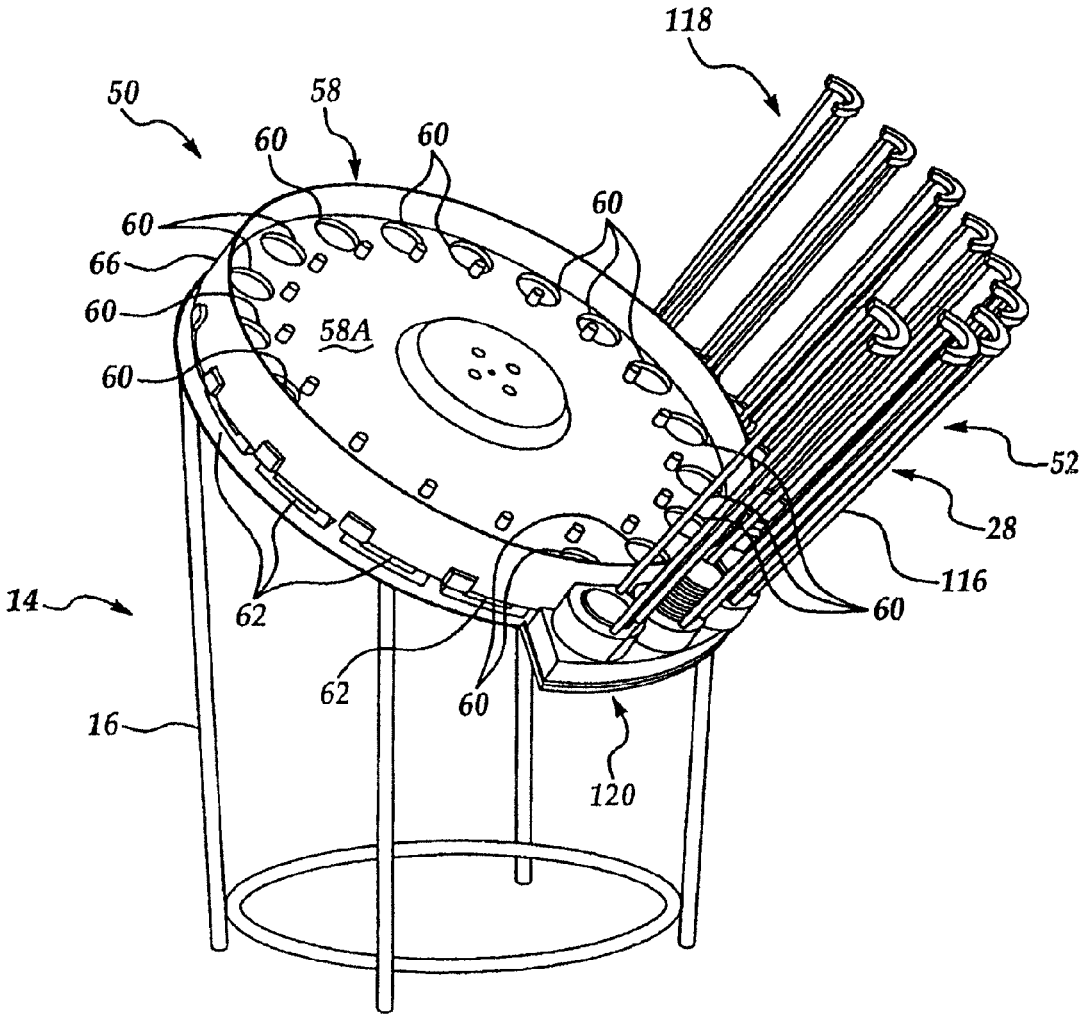
FIG. 3 is a second diagrammatic illustration of the apparatus of FIG. 1, according to an embodiment of the present invention.
Figure 4:
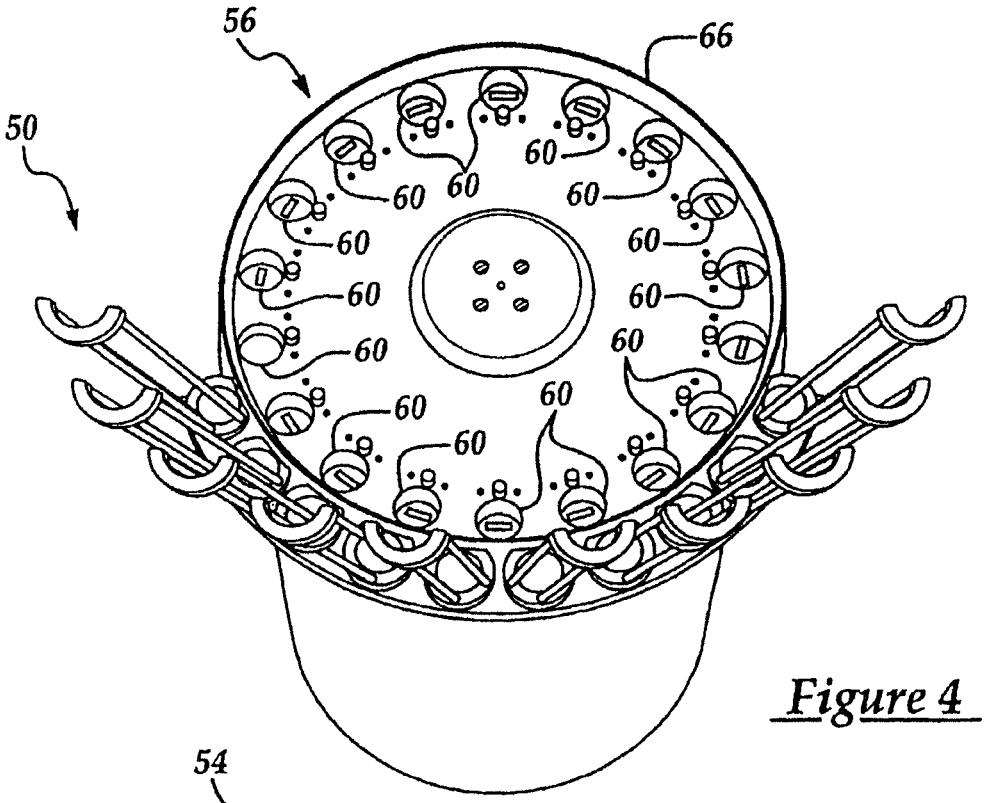
FIG. 4 is a top diagrammatic illustration of the apparatus of FIG. 1, according to an embodiment of the present invention.
Figure 5:
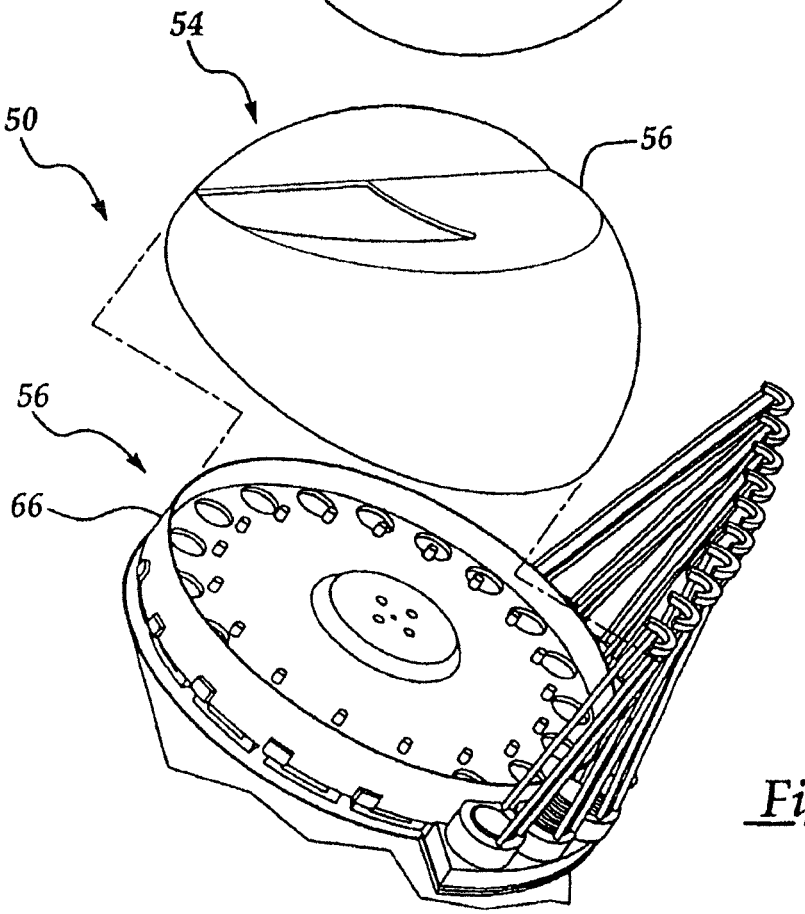
FIG. 5 is an exploded view of a portion of the apparatus of FIG. 1, according to an embodiment of the present invention.

With reference to FIGS. 2 and 3, the apparatus 10 includes a housing 14 which in the illustrated embodiment, includes a frame 16 having a circular cross-section. The frame 16 may be covered by a flexible protective cover 18.

Returning to FIG. 1, the apparatus 10 also includes a wheel 20 and a motor 22 coupled to the frame 16 and the wheel 20. The wheel 20 includes at least one hole forming a well (see below) for receiving one of the disks 12. The wheel 20 is rotatably coupled to the frame 16 and is rotated about an axis 24 (see FIG. 2) by the motor 22.

A disk parameter sensor 26 is coupled to the frame 16 and positioned relative to the well. The sensor 26 senses a value of the parameter of the disk 12 in one of the wells and responsively generates a parameter value signal as a function of the value. The sensor 26 is dependent upon the nature of the parameter. For example, in one embodiment, the parameter is color and the sensor 26 is a color sensor. It should be noted, however, the sensor 26 may be a digital image sensor, a bar code reader, or RFID detector, or any other suitable sensor for sensing, detecting or reading the value of the parameter. In the embodiment, discussed below, the sensor 26 is a color sensor, but the present invention is not limited to such.

The apparatus 10 further includes a collecting device 28 coupled to the frame 16 and positioned relative to the wheel 20. The collecting device 28 includes a collecting device assembly 29 having a first end 29A and a second end 29B.

The collecting device 28 includes a plurality of collectors 30 (see FIG. 2).

In one embodiment, each collector 30 has first and second ends. The first ends of the plurality of collectors 30 are aligned with the first ends 29A of the collecting device assembly 29. The second ends of the plurality of collectors 30 are aligned with the second ends 29B of the collecting device assembly 29. The first ends of the plurality of collectors 30 are arranged in a semi-circle having a first radius. In the illustrated embodiment, the collecting device 28 is a rack 32 and the plurality of collectors 30 are column assemblies 34. The rack 32 is described more fully below.

In another embodiment, the plurality of collectors 30 may be individual bags (not shown) connected to the frame 16 which are positioned relative to the wheel 20 for collecting the disks 12 as the disks 12 are ejected (see below).

At least one ejector 36 is coupled to the frame 16 and positioned relative to the well (see below). The ejector 36 ejects the disk 12 from the well in response to receiving an eject signal.

A controller 38 is coupled to the disk parameter sensor 26 and the ejector 36. The controller 38 receives the parameter value signal and responsively sends an eject signal to the ejector 36 to eject the disk 12 from the well into the first collector 30 when the parameter value signal has a first value and for sending an eject signal to the ejector 36 to eject the disk 12 from the well into the second collector 30 when the parameter value signal has a second value. The plurality of collectors 30 are spaced apart at a predetermined angle, e.g., 15 degrees.

In another aspect of the present invention, the apparatus 10 may include a position sensor 40. The position sensor 40 is coupled to the frame 16 and senses the relative position of the wheel 20 as it rotates. The position sensor 40 generates a position signal, which is delivered to the controller 38 (see below). In still another aspect of the present invention, the apparatus 10 may include a motor position sensor 22A for sensing a position of the motor 22 (see below).

With specific reference to FIGS. 2-16, an exemplary sorting device 50 for the sorting of gaming chips 52, according to one embodiment of the present invention is illustrated. The gaming chips 52 are flat disks, which only differ from one another by their color and/or value.

The sorting device 50 is built in such a way that it may be positioned next to the dealer at the gaming table (not shown). This allows the dealer to rake or move the gaming chips 52 into a storage compartment 54 and pick up stacks of sorted chips 52 in batches of twenty or other pre-determined amounts, and place them onto the table before handing them out to the players. The sorting device 50 has a feed 56 into the storage compartment 54 that may also serve as a cover.

A wheel 58 rotates inside the storage compartment 54. The wheel 58 has a plurality of holes 60 spaced apart. In the illustrated embodiment, the wheel 58 has eighteen holes 60 spaced 20 degrees apart.

Underneath each of the holes 60 in the wheel 58, a well 62 is attached. The wells 62 immediately absorb or accept the chips 52 dropped from the storage compartment 54. Each well 62 has an ejector compartment 104.

The wheel 58 may also include a plurality of studs 64 located adjacent the plurality of holes 60 on the wheel 58. The plurality of studs 64 on the wheel 58 assist in evenly distributing the chips 52 on the wheel 58.

In addition, one or more chip reflector plates 66 may be mounted to the edge of the wheel 58. The straight corners of the chip reflector plate 66 assist in the distribution of the chips 52 and avoid endless "running" of the chips 52 along the edge of the wheel 58.

Figure 6:
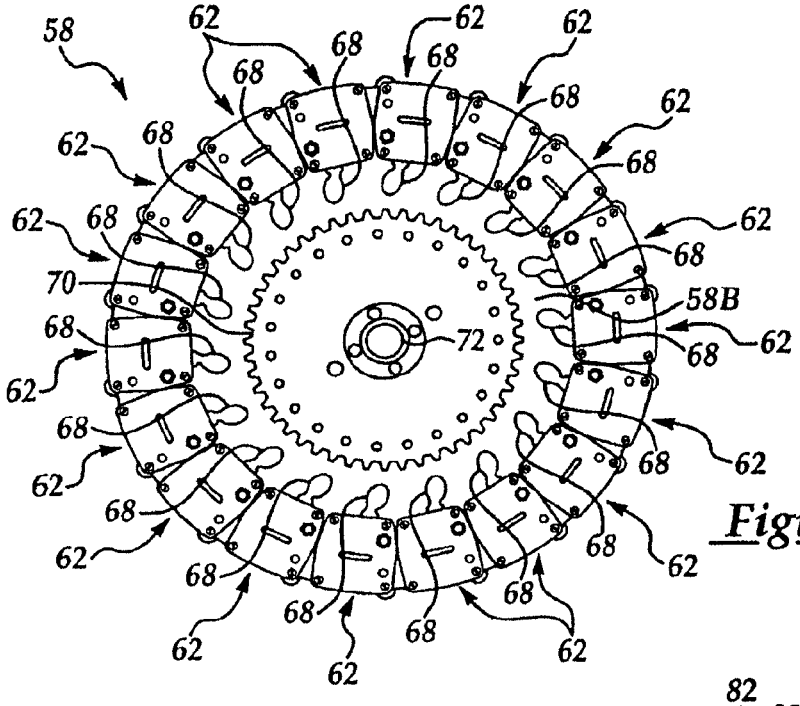
FIG. 6 is a diagrammatic illustration of a bottom view of a wheel of the apparatus of FIG. 1, according to an embodiment of the present invention.

With specific reference to FIG. 6, the bottom of the wheel 58 shows the eighteen attached wells 62. Each well 62 has an associated ejector lever 68, which is movable between first and second positions. The first position is shown in FIGS. 6 and 9 is the default position, i.e., pointing towards the center of the wheel 58.

Figure 9:
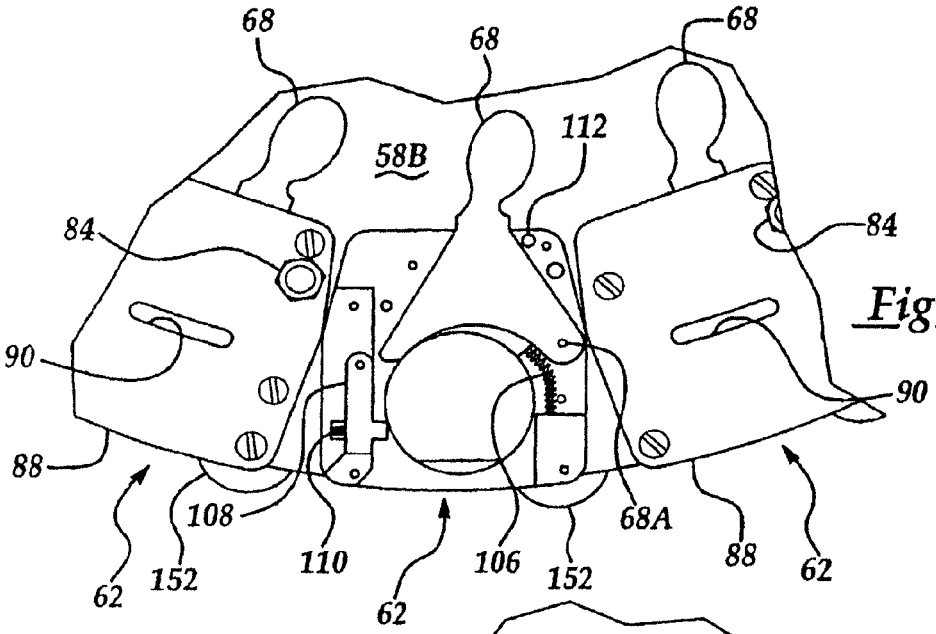
FIG. 9 is a diagrammatic illustration of an ejector of the apparatus of FIG. 1, according to an embodiment of the present invention.

With specific reference to FIG. 9, each ejector lever 68 pivots about a pivot point 68A. The ejector lever 68 is shown in the first or default position. As described below, the ejector lever 68 may be pivoted about the pivot point 68A in a counter-clockwise direction towards the second position to eject a chip 52 in the associated well 62.

The wheel 58 has an upper surface 58A and a bottom surface 58B. A large sprocket wheel 70 is mounted to the bottom surface 58B of the wheel 58. An axle 72 is mounted at the center of the wheel 58.

Figure 7:
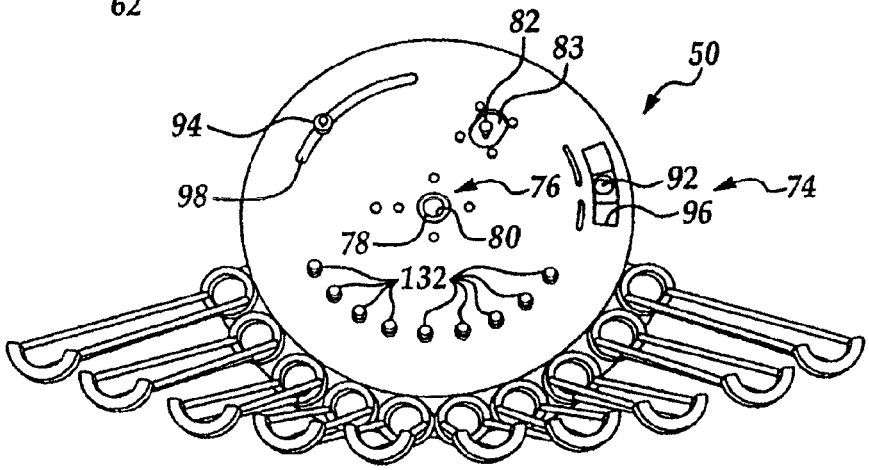
FIG. 7 is a diagrammatic illustration of a base plate of the apparatus of FIG. 1, according to an embodiment of the present invention.

With specific reference to FIG. 7, the apparatus or sorting device 10 may also include a base plate 74 mounted to the frame 16. The base plate 74 has an aperture 76. A shaft 78 is disposed within the aperture 76 and has an inner bore 80.

The axle 72 slides into the inner bore 80 of the shaft 78 at the base plate 74 so that the wheel 58 may rotate. The sprocket wheel 70 is used to drive the wheel 58 forward by a drive gear 82 of a motor 83, such as a stepper motor, fixed to the base plate 74.

At various points, metal reference pins 84 (see FIG. 9) are placed at the bottom of the wheel 58 to monitor the position of the wells 62 relative to the collecting device 28 (see below), which are placed at fixed positions on the base plate 74, outside the circumference of the wheel 58.

In the illustrated embodiment, each well or ejector compartment 62 has an associated metal reference pin 84 mounted thereto as a reference. The metal reference pins 84 are spaced 20 degrees apart since the wells 62 are spaced 20 degrees apart. The metal reference pins 84 are detected by a synchronization sensor 94 such as a hall effect sensor, as the wheel 58 rotates.

In addition, the motor position sensor 22A may be an encoder mounted adjacent the motor 83, 22. In one embodiment, 1-degree reference points are measured directly from the motor position sensor 22A or encoder. The data collected from these reference points is used to determine when an ejector compartment 104 is aligned with a collector 30 of the collecting device 28 (which is every five degrees) so that, when needed, a chip 52 can be ejected from the well 62 into a collector 30.

Each well 62 includes a bottom plate 88. Each bottom plate 88 includes a small slotted cutout 90. A color sensor 92 is mounted to the base plate 74 and reads the chip 52 when it passes the color sensor 92.

In the illustrated embodiment, the color sensor 92 and the synchronization sensor 94 are mounted to the bottom surface 58B of the base plate 74 adjacent an associated aperture 96, 98. The motor position sensor 22A senses each 1-degree of movement of the motor 22, 83 and generates 1-degree reference point signals.

Figure 8:
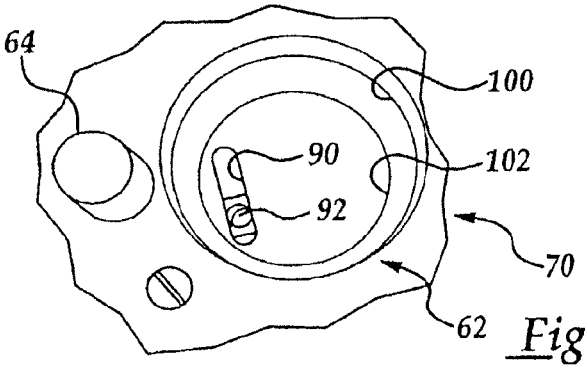
FIG. 8 is a diagrammatic illustration of a well of the apparatus of FIG. 1, according to an embodiment of the present invention.

With reference to FIG. 8, the shape of the wells 62 is such that the diameter at the top 100 (the part of the well 62 attached to the wheel 58), is larger than the diameter at the bottom 102. This creates a funnel that facilitates the collection of the chips into a stack in the well 62.

Figure 10:
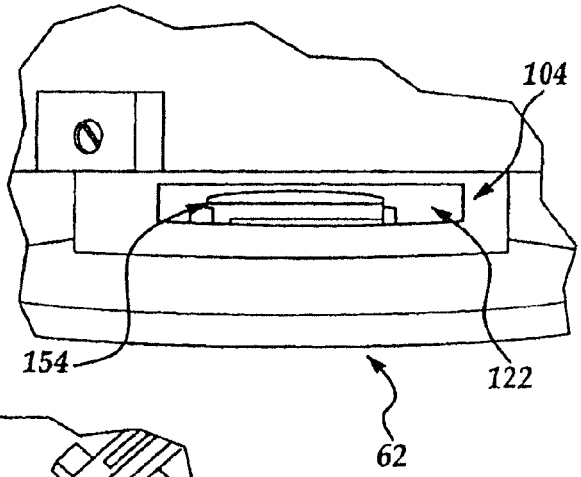
FIG. 10 is a diagrammatic illustration of a side view of the ejector of the apparatus of FIG. 9, according to an embodiment of the present invention.

In the illustrated embodiment, the ejector compartment 104 can hold just one chip 52 and is located at the bottom of each well 62. As discussed below, chips 52 are ejected from the ejector compartment 104. When chips 52 drop from the storage compartment 54 and onto the wheel 58, the chips 52 will, after a few turns of the wheel 58, fill up the wells 62. Since the wheel 58 rotates constantly, the plurality of studs 64 assist with the distribution of the chips 52. The first chip 52 that falls into an empty well 62 will land at the bottom part of the well, i.e., the ejector compartment 104. With reference to FIGS. 6, 9, and 10, each ejector compartment 104 has an associated ejector lever 68. A spring 106 biases the ejector lever 68 to the default position. A retention clip 108, second spring 110, and a rubber stop 112 are arranged to absorb the sound of the returning ejector lever 68. The retention clip 108 retains the chip 52 from falling out of the ejector compartment 104 as the wheel 58 is rotating.

With specific reference to FIGS. 2-5 and 7, in the illustrated embodiment the collecting device 28 is a rack 32 which includes a rack assembly 116. The rack assembly 116 includes a plurality of column assemblies 118 and a rack base portion 120. In the illustrated embodiment, the rack assembly 116 has nine column assemblies 118.

In operation, the ejector lever 68 pushes the chip 52 out of the ejector compartment 104 into one of the nine column assemblies 118, which are mounted at a fixed position on the base plate 74 via the rack base portion 120. As the chip 52 is pushed out more than 50%, a flattened edge 122 of the ejector compartment 104 (see FIG. 10) forces the chip 52 into one of the column assemblies 118.

The base plate 74 is placed at an angle to allow the chips 52 in the storage compartment 54 to drop directly onto the rotating wheel 58. The shaft 78 in the center of the base plate 74 will accept the wheel axle 72.

Figure 11:
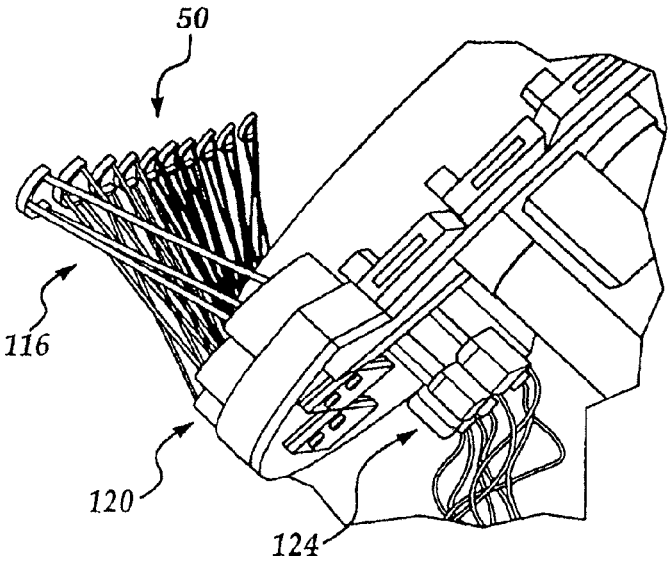
FIG. 11 is a diagrammatic illustration of a side view of the base plate side of FIG. 7.

With specific reference to FIG. 11, nine push-type solenoids 124 (only three of which are visible) are mounted to the base plate 74. Also mounted to the base plate 74 are the rack assembly 116, the motor 22, the synchronization sensor 94, the color sensor 92 and the motor position sensor 22A. An empty well sensor (not shown) may also be mounted to the base plate 74.

Figure 14:
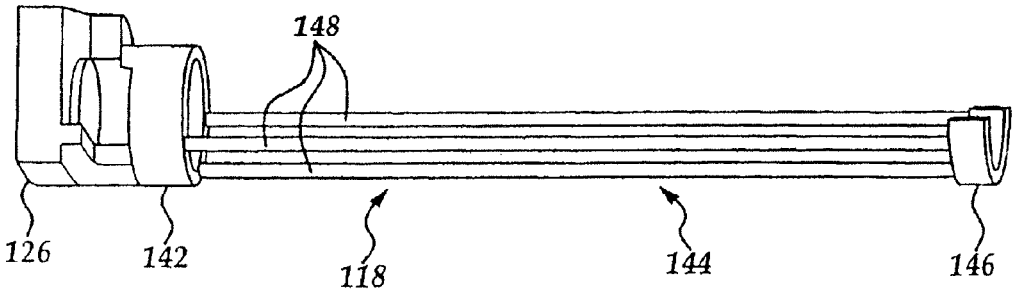
FIG. 14 is a diagrammatic illustration of a collector of the apparatus of FIG. 1, according to an embodiment of the present invention.
Figure 15:
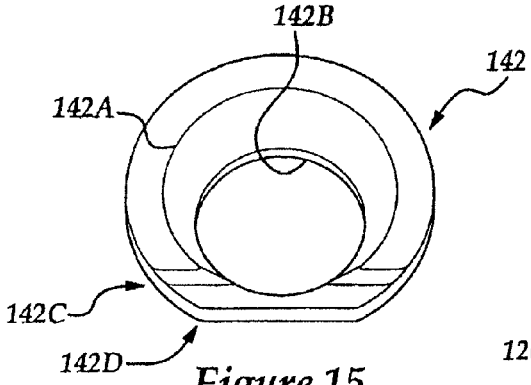
FIG. 15 is a diagrammatic illustration of a guide of the apparatus of FIG. 1, according to an embodiment of the present invention.
Figure 16:
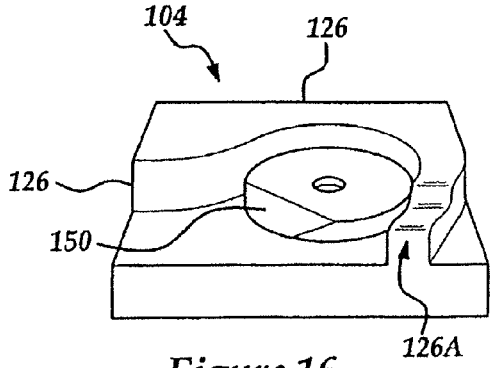
FIG. 16 is a diagrammatic illustration of a receptor of the apparatus of FIG. 1, according to an embodiment of the present invention.

With specific reference to FIGS. 14-16, the rack base portion 120 forms nine receptors 126. The centers of the nine receptors 126 are 15 degrees apart in the bottom half of the wheel 58. Such spacing allows the column assemblies 118 which are mounted on top of the receptors 126, to be placed as close together as possible, limiting the circular arm motion of the dealer when he needs to remove chips 52 from the column assemblies 118. The solenoids 124 are also placed 15 degrees apart in a direct line with the receptors 126. The drive gear 82 drives the large sprocket wheel 70. While the wheel 58 and the attached wells 62 are continuously rotating, the base plate 74 and the affixed solenoids 124, receptors 126 and sensors 92, 94 and 22A remain in their fixed position.

Figure 12:
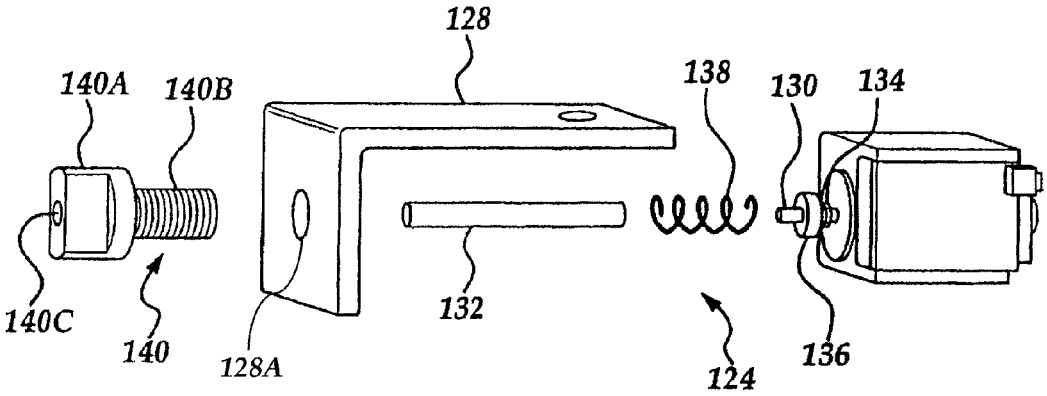
FIG. 12 is a diagrammatic illustration of an exploded view of a solenoid of the apparatus of FIG. 1, according to an embodiment of the present invention.
Figure 13:
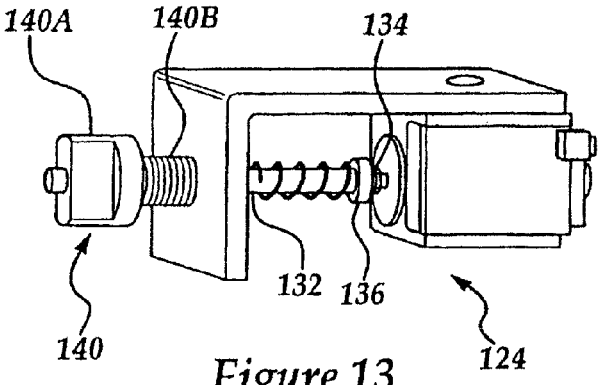
FIG. 13 is a diagrammatic illustration of the solenoid of the apparatus of FIG. 12.

The nine push-type solenoids 124 are fixed to the base plate 74 in line with the receptors 126. With reference to FIGS. 7, 12 and 13, each solenoid 124 is mounted on a bracket 128 by an appropriate fastener (not shown). A shaft 130 of the push-type solenoid 124 is extended with a small plunger 132. Two nuts 134 on the shaft 130 allow for adjustment of the stroke length. A nylon washer 136 is also mounted on the solenoid shaft 130 on which a spring 138 rests. The spring 138 will accelerate the plunger 132 in moving back to its default position when the solenoid 124 is deactivated. The plunger 132 moves through a shaft nut 140 which is screwed into the base plate 74.

The shaft nut 140 provides operational stability. The shaft nut 140 includes a head portion 140A and a threaded portion 140B. The threaded portion 140B is threaded through an aperture in the base plate 74 (not shown) and an aperture 128A in the bracket 128, such that the head portion 140A is on an upper surface of the base plate 74 (see FIG. 7). When the solenoid 124 is assembled and activated, the plunger 132 extends through a bore 140C of the shaft nut 140, past the base plate 74 and the head 140A of the shaft nut 140.

A solenoid 124 is activated only when there is a space in between any two ejector levers 68 that are in rotation above it. As the wheel 58 rotates, when a solenoid 124 is activated, the ejector lever 68 makes contact with the plunger 132 of the solenoid 124, which causes the ejector lever 68 to move to its outermost pivotal point (the second position) thereby simultaneously forcing the chip 52 out of the ejector compartment 104. The timing of the ejection of the chip 52 is determined by the synchronization sensor 94, and the controller 38 (see below).

With specific reference to FIGS. 14-16, in one embodiment each column assembly 118 includes one of the receptors 126, a chip guide 142, a column 144, and an end cap 146. The receptors 126 and chip guides 142 form the rack base portion 120. Each column 144 is made from three column rods 148 as shown.

Figure 17:
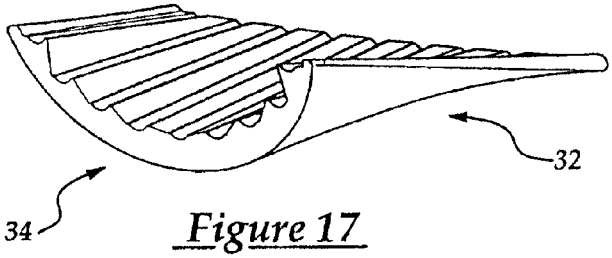
FIG. 17 is a diagrammatic illustration of a rack for use with the apparatus of FIG. 1, according to an embodiment of the present invention.
Figure 18:
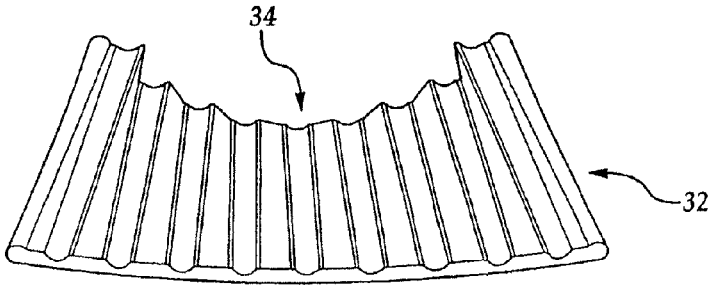
FIG. 18 is a second diagrammatic illustration of the rack of FIG. 17.

In another embodiment, the rack 32 is unitarily formed (see FIGS. 17 and 18). As shown in FIGS. 17 and 18, each column assembly 34 is has an elongated opening to enable lateral disk removal. That is, disks may be removed from the side of each column assembly 34.

The bottom of the receptor 126 is level with the bottom of the ejector compartment 104. With specific reference to FIG. 16, the receptor 126 has a flange 150 at the bottom that forces a chip 52 to become wedged under the other chips 52 that are stored above it in the chip guide 142 and the column 144.

With reference to FIG. 15 (which shows the chip guide 142 in an upside down position), the inside 142B of the chip guide 142 is shaped like a funnel to assist in the alignment of the chips 52 into the column 144. The bottom 142A of the chip guide 142 is larger in diameter than the top 142D of the chip guide 142. A cut-out 142C at the bottom 142A of the chip guide 142 and the top of a reflector 126A is required to allow a cam 152 to pass. The chip guide 142 also has a cut-out at the top 142D to allow the chip reflector plates 66 to pass.

Returning to FIG. 14, the end cap 146 not only contains the column rods 148 which form the column 144, but may also contain a small Hall effect sensor built in that is used to sense a "column full" condition. When the wheel 58 is in motion, the chip color or value sensor 92, which is mounted to the base plate 74, determines the chip's identity through the small cutout 79 in the bottom plate 88 of the ejector compartment 104. All data from the sensors 92, 94, 22A is processed by the controller 38, which, based upon the color value read, activates the appropriate solenoid 124 to discharge and consequently eject the chip 52 into the corresponding column assembly 118. A small additional sensor (see above) may be used to monitor the empty status of all the wells 62. No ejection will take place if the well 62 is empty.

In the illustrated embodiment, the synchronization sensor 94 is mounted at the base plate 74 (the "Sync A" sensor) and the motor position sensor 22A is mounted at the stepper motor 83 (the "Sync B" sensor). The Sync A sensor 94 monitors the metal reference pins 84 mounted to the ejector compartment 104. Every 20 degrees a metal reference pin 84 passes the sensor 94 and a Sync A pulse is generated. The Sync B sensor 22A generates a pulse for every 1 degree rotation of the wheel.

The plurality of holes 60 on the wheel 58 are placed 20 degrees apart and the receptors 126 are placed 15 degrees apart. Columns are numbered column 1 through column 9. Column 1 is the left-most column and the Sync A sensor 94 is placed at 20 degrees forward of column 1. When the hole 60 (n) is positioned in front of the receptor 126 at column 1, hole (n+3) 60 will be positioned in front of the receptor 126 at column 5 and hole (n+6) 60 will be positioned in front of the receptor 126 at column 9. Every 20 degrees (Sync A signal) that the wheel rotates, the next hole (n+1) 60 will be positioned in front of the receptor 126 at position 1, and so on. The alignment of a hole 60 in front of ejector column 1 happens with the Sync A signal. The Sync A sensor 94 is positioned exactly at that point that the solenoid 124 needs to be activated so that the ejector lever 68 will push the chip 52 into the receptor 126 of column 1. When the wheel 58 moves 5 degrees forward (counting five Sync B signals), hole (n+1) 60 is now aligned with the receptor 126 of column 2 and at the same time hole (n+4) 60 is aligned with the receptor 126 of column 6. When the wheel 58 moves forward another 5 degrees, hole (n+2) 60 is now aligned with the receptor 126 of column 3 and at the same time hole (n+5) 60 is now aligned with the receptor 126 of column 7. When the wheel moves 5 degrees forward, hole (n+3) 60 is now aligned with the receptor 126 of column 4 and at the same time hole (n+6) is aligned with the receptor 126 of position 8. When the wheel 58 moves forward another 5 degrees the wheel 58 has moved 20 degrees ahead and now hole (n+1) 60 is aligned with the receptor of column 1 while at the same time, hole (n+4) 60 is aligned with the receptor 126 of column 5 and hole (n+7) 60 is aligned with the receptor 126 at column 9.

In other words, since holes 1, 5, and 9 are separated by a multiple of 20 degrees, at any time hole 1 is aligned with a receptor 126, holes 5 and 9 are also aligned with a receptor 126 Likewise, since holes 2 and 6 are separated by a multiple of 20 degrees, at any time, hole 2 is aligned with a receptor 126, hole 6 is also aligned with a receptor 126. The same is true for holes 3 and 7 and for holes 4 and 8.

Whenever the plurality of holes 60 match receptor 126 positions, the respective solenoids 124 are activated when the respective chip color of a chip 52 in the respective ejector compartment 104 matches a pre-assigned color of the destination column assembly 118. This assists in increasing the sorting efficiency. When the hole 60 (and ejector compartment 104) and receptor 126 are aligned, the solenoid 124 will be activated if the color of the chip 52 in the ejector compartment 104 matches the pre-assigned color of a destination column assembly 118, which will result in its plunger 132 moving upwards from the base plate 74. The solenoid 124 is activated by the controller 38 at a point in time when the next-arriving ejector compartment 104 contains the appropriate-colored chip 52. Since the wheel 58 is continuously moving, the result is that the ejector lever 68 will be hit by the top of the plunger 132 of the solenoid 124 and will continue to extend outwards from its pivot point 68A for the duration of contact with the plunger 132. The ejector lever 68 is curved in such a way that the chip 52 will be pushed out as fast as possible. When the solenoid 124 is deactivated its plunger 132 drops back down rapidly. The ejector lever 68 will then move back to its default position by means of the spring 138, ready for the next ejection action. The ejector lever 68 will push the chip 52 more than 50% out of the ejector compartment 104 into the receptor 126. Since the wheel 58 is still turning, and the chip 52 is already more than 50% out of the ejector compartment 104 into the receptor 126, the momentum of the wheel 58 will push the chip 52 into the receptor 126, aided by the flattened edge 122 of the ejector compartment 104. The shape of the flange 150 forces the chip 52 to become wedged underneath the stack of chips 52 already in place. This in turn forces the previously positioned chips 52 upwards. However, when the chip 52 is coming out of the ejector compartment 104 and onto the wedged bottom of the receptor 126, the chip 52 is inclined upwards. Therefore the exit section 154 of the ejector compartment 104 is taller then the thickness of the chip 52 to allow the chip 52 to move sufficiently upwards without jamming the wheel 58 (see FIG. 10). The number of chips 52 that can be pushed up is limited by the power that the driving mechanism can provide, relative to the weight of the chips 52 in the column assembly 118. The sprocket wheel 70 to motor sprocket wheel ratio of 17.14/1 provides the necessary force to push the column of chips 52 up without any difficulties. A practical limit of 100 chips 52 per column has been chosen, but the design allows for easy extension of the columns.

The chip guide 142 assists with the alignment of the chips 52 into the column assemblies 118. The small cam 152 is mounted at the outside of each well 62 on the chip reflector plates 66 in order to assist with the alignment of the stacked chips 52 in the bottom of the receptor 126.

While the wheel 58 turns, the color sensor 92 reads the value of the gaming chip 52 and determines into which of the nine column assemblies 118, the chip 52 needs to be ejected. The color associated with a column assembly 118 is determined by placing the sorting device 50 in a "training mode." The wheel 58 needs to be empty before the training mode is started. Once in the training mode, the color of the first chip 52 that is dropped into the sorting device 50 will be stored as the associated or pre-defined color assigned to column 1. After that, the second chip 52 is dropped into the device 10. The color of the second chip 52 is read and assigned to the second column assembly 118, and so on.

In another aspect of the present invention, a method for receiving and sorting disks 12 having a parameter is provided. The parameter of each disk 12 has one of a plurality of values. The method includes the steps of rotating the wheel 20. The wheel 20 includes at least one well 62 for receiving a disk 12. The method also includes the steps of receiving a first disk 12 in a first well 62 and sensing the value of the parameter of the first disk 12. The method further includes the step of ejecting the first disk 12 into one of a plurality of collectors 30 when the first well 62 is aligned with the one collector 30 and the value of the parameter of the first disk 12 is equal to a value associated with the one collector 30.

The wheel 20 may include additional wells 62 for receiving additional disks 12. The value of the parameter of the disks 12 received in the additional wells 62 are sensed and the disks 12 are ejected into a collector 30 based on color.

Disks 12 in different wells 62 may be ejected into a respective collector 30 substantially simultaneously.

For example, in the illustrated embodiment discussed above, there are eighteen wells 62 spaced along the wheel 58 at 15 degree intervals. Disks 12 are sorted and ejected into nine column assemblies 118 spaced at 20 degree intervals. Furthermore, as discussed above, whenever the first column assembly 118, i.e., column 1, is aligned with a well 62, so are columns 5 and 9 Likewise, columns 2 and 6, columns 3 and 7, and columns 5 and 9 are aligned with wells 62 at the same time. Thus, if any set or subset of wells 62 are aligned with column assemblies 118 and contain a chip whose parameter has a value equal to the value associated with the column assembly 118 to which it is aligned, the chips 52 in the set or sets of wells 62 may be ejected at the same time.

INDUSTRIAL APPLICABILITY

The sorting device according to this invention is compact, as it is designed using a rotating circular plate placed at an angle. This plate contains eighteen holes which are slightly larger than a chip, and each hole has a well or reservoir attached to it in the shape of a funnel to efficiently absorb the influx of gaming chips. The funnel allows the chips to align themselves easily. The advantage of the well is that it pre-stores the chips and hence allows the device to be more compact and efficient. There is no practical limit to the size of the well or the number of chips it can store. As can be seen in the existing chip sorting devices, sorting of chips is accomplished by the use of a plunger that pushes the gaming chips from a conveyor belt upward in order to stack them into their appropriate column. The first problem with this method is that knives are used to separate the chips from the conveyor belt in order to be pushed up into the column. These knives need to be frequently replaced. This invention accomplishes the sorting and stacking with one single movement, which dramatically reduces the complexity and size of the device. This is to the benefit of the operator.

The second problem with previous devices is that the gaming chips fall initially into a chamber or receptacle before they come into contact with the "transporting" device (i.e., the conveyor belt). This causes the chips to get stuck between the immobile chamber and the moving belt and jam the machine. With the new invention, all the chips fall directly onto the moving part (i.e., the rotating disk), so there is no possibility of interference from being transferred to an additional mechanism.

In addition, while other devices separate gaming chips one by one, this invention allows for simultaneous separation from multiple wells.

Besides the motor, there are only two moving parts required to separate and stack the gaming chips. The number of receptors is configurable and can be equal to the number of wells in the wheel. Due to the fact that the receptors are positioned around and outside the disk, and the disk may be suspended with a minimal footprint, ergonomic advantages, from an operational perspective, are dramatically increased. The 135 degree circle allows the dealer to stand either to the side, or directly behind the machine, to reach the gaming chips and also the table simultaneously.

Because the column array is positioned along the lower half of the wheel's circumference, any chip entering any column is subject to gravitational force, thus allowing the radius of the entire column array to be spread along a more lateral and flatter plane than the semi-circular shape of the wheel (in a smooth V-shape rather than a conventional U-shape). This option permits easier access to the individual columns, and reduces the distance between the bottom-most column and the table edge, by allowing the machine to be placed further under the table than would be allowed with a perfect semi-circular shape.

The invention also allows for separation by either directly stacking the disk-like articles in columns in an upward motion or directly dropping them into any form of receptacle using gravity. An example of this is a coin-sorting device by which coins are separated and dispensed appropriately.

In addition to casinos, the device may be used in card rooms, for sorting chips into bags, boxes or other receptacles.

The following are considered the core elements of the invention:

a. Rotational Momentum of the Wheel

The device uses the natural inertia of the wheel to complete the ejection of a chip outside its original trajectory (unlike the Chipper Champ—above its original trajectory).

b. Ejection Lever Method

The lateral ejection method applies pressure along the entire half-circumference of the chip, thereby ensuring contact with the chip's most solid surface (unlike the Chipper Champ, which applies pressure at vulnerable underside of chip).

c. Transfer Mechanism Eliminated

The chips fall directly onto the rotating surface of the sorting apparatus (unlike the Chipper Champ, which contains incoming chips into a hopper before transferring them to the ejecting device—their conveyor belt).

d. Solid One-Piece Wheel

Because the wheel is a one-piece-manufactured body, it is impossible for any movement or space differential between the wells, thus eliminating any potential timing errors (unlike the Chipper Champ, where there are continual spacing and consequential timing differentials between cups and segments).

e. Arm Movement

The circular shape and the outward angle of the column array allows the dealer's arm access to all the columns in the same plane (unlike the Chipper Champ where the dealer must physically reposition his body to access the outermost columns).

f. Footprint

Because the main body of the machine is located directly under the table, and does not extend downwards to the floor, the footprint is small, and thus there is no impediment to the dealer's feet (unlike the Chipper Champ, where the machine sits on the floor and occupies dealer foot space).

g. Apron Space

Because the machine is compact, it can be located entirely under the table without the need for a section to be cut out (unlike the Chipper Champ where the bulkiness of the machine necessitates a cut-out in the table to maintain proximity).

h. Dispensing Method

The dealer only has to rotate the chips through approximately 90 degrees to grasp a stack of chips (unlike the Chipper Champ—approximately 180 degrees).

i. Weight

ChipperWheel weighs about half of Chipper Champ.

j. Size/Mass

ChipperWheel is about half the mass of Chipper Champ.

k. Lateral Ejection Method

Because the ChipperWheel ejects chips laterally from the wheel to the column base, there is no need for an ancillary device between the two elements (unlike the Chipper Champ which necessitates knives).

l. Gravity Option

As well as upward-stacking capability, ChipperWheel chips can be gravity-stacked downwards (unlike Chipper Champ which only has an upward option).

m. Wells

The ChipperWheel wells have multi-chip capacity (unlike the Chipper Champ-single chip capability only).

n. Chip Dispersion/Absorption

Because of the multi-chip well capability, the incoming chips are dispersed and absorbed quicker than the Chipper Champ.

o. Angle of Operation

The ChipperWheel can be rotated on differing horizontal angles, allowing greater operational flexibility (unlike the Chipper Champ which has a fixed angle).

p. Security

Any chips that are dropped by the dealer when retrieving stacks from columns will fall safely to the base of the column array (unlike the Chipper Champ where dropped chips often fall down behind the machine onto the floor and get lost).

q. Service Accessibility

Technician has easy access to the ChipperWheel, even if a live game is in play (unlike the Chipper Champ).

r. Single Shaft

The ChipperWheel uses only one shaft, unlike the Chipper Champ, whose belt revolves around three separate shafts.

Obviously, many modifications and variations of the present invention are possible in light of the above teachings. The invention may be practiced otherwise than as specifically described within the scope of the appended claims.

What is claimed is:

1. An apparatus for receiving and sorting disks, comprising:

a body comprising at least one well for receiving a disk, wherein the body is configured to direct the disk along a path;

a collecting device positioned relative to the body, the collecting device having at least one collector configured for receiving disks;

an ejector coupled to the body proximate the at least one well and configured to eject a disk from the at least one well in a direction different from a direction of the path in response to an eject signal; and a lifting mechanism comprising:

a flange for lifting and directing ejected disks into the at least one collector of the collecting device; and a pivotally mounted ejector lever configured to laterally move a chip into contact with the flange.

2. The apparatus of claim 1, wherein the flange is configured to wedge a disk between the lifting mechanism and another disk when the ejector ejects the disk from the at least one well.

3. The apparatus of claim 1, wherein the at least one collector comprises two or more collectors configured for receiving disks.

4. The apparatus of claim 3, further comprising a controller operably coupled with a disk sensor and the ejector, wherein the disk sensor is configured to detect a parameter value of a disk, and wherein the controller is configured to generate the eject signal.

5. The apparatus of claim 4, wherein the eject signal is sent to the ejector for ejecting a disk from the at least one well into one of the two or more collectors according to the parameter value of the disk.

6. The apparatus of claim 4, wherein the disk sensor comprises at least one sensor selected from the group consisting of a color sensor, a digital image sensor, a bar code reader, and a radio frequency identification detector.

7. The apparatus of claim 1, wherein the ejector comprises a solenoid.

8. The apparatus of claim 1, wherein the collecting device comprises a rack comprising a rack assembly and a plurality of column assemblies.

9. The apparatus of claim 8, wherein the rack assembly and the plurality of column assemblies comprise a unitary structure.

10. The apparatus of claim 1, wherein the path is circular.

11. An apparatus for receiving and sorting disks, comprising:

a body comprising at least one well for receiving a disk;

a collecting device adjacent the body, the collecting device having at least a first collector and a second collector configured for receiving disks;

a disk sensor configured to detect a property of a disk and generate a first signal in response to the detected property of the disk;

at least one lift mechanism configured to lift a disk from the at least one well to the collecting device in response to a second signal;

a controller operably coupled with the disk sensor and the at least one lift mechanism, the controller configured to generate the second signal, wherein the second signal is sent to the at least one lift mechanism for lifting a disk from the at least one well into one of the first collector and the second collector according to the first signal;

wherein the at least one lift mechanism comprises a body having a flange configured to direct a disk to one of the first collector and the second collector according to the second signal.

12. The apparatus of claim 11, wherein the body comprising at least one well for receiving a disk is configured to direct the disk along a path.

13. The apparatus of claim 12, wherein the path is circular.

14. The apparatus of claim 11, wherein the disk sensor comprises at least one sensor selected from the group consisting of a color sensor, a digital image sensor, a bar code reader, and a radio frequency identification detector.

15. The apparatus of claim 11, wherein the at least one lift mechanism comprises a pivotally mounted ejector lever that laterally moves a chip into contact with the flange.

16. The apparatus of claim 11, wherein the collecting device comprises a plurality of column assemblies secured to a rack assembly.

17. The apparatus of claim 16, wherein the rack assembly and the plurality of column assemblies are unitarily formed.

18. The apparatus of claim 16, wherein each column assembly of the plurality of column assemblies has an elongated opening configured to enable lateral removal of a disk.

19. The apparatus of claim 11, wherein the body comprising at least one well for receiving a disk comprises at least two wells, and wherein the at least one lift mechanism comprises at least two lift mechanisms, each lift mechanism configured to lift a disk from one of the at least two wells.

20. The apparatus of claim 11, further comprising a position sensor configured to detect an alignment of the at least one well with respect to the collecting device.

* * * * *